US006951222B2

(12) United States Patent
Liao

(10) Patent No.: US 6,951,222 B2
(45) Date of Patent: Oct. 4, 2005

(54) RADIATOR CLEANING DEVICE

(75) Inventor: Po-Lin Liao, Taichung (TW)

(73) Assignee: Lih Yann Co., LTD, Taichung (TW)

( * ) Notice: Subject to any disclaimer, the term of this patent is extended or adjusted under 35 U.S.C. 154(b) by 475 days.

(21) Appl. No.: 10/115,296

(22) Filed: Apr. 3, 2002

(65) Prior Publication Data

US 2003/0188771 A1 Oct. 9, 2003

(51) Int. Cl.[7] ..... B08B 3/04

(52) U.S. Cl. ..... 134/111; 134/169 R; 134/166 R; 134/169 A; 134/186

(58) Field of Search ..... 134/111, 166 R, 134/169 R, 169 A, 184, 186

(56) References Cited

U.S. PATENT DOCUMENTS

| | | | | | |
|---|---|---|---|---|---|
| 4,791,890 | A | * | 12/1988 | Miles et al. | 123/41.14 |
| 4,991,608 | A | * | 2/1991 | Schweiger | 134/56 R |
| 5,094,757 | A | * | 3/1992 | Light | 210/712 |
| 6,213,175 | B1 | * | 4/2001 | Rome et al. | 141/98 |
| 6,523,580 | B1 | * | 2/2003 | Awad | 141/65 |

* cited by examiner

*Primary Examiner*—Frankie L. Stinson

(57) ABSTRACT

A radiator cleaning device includes a fresh fluid tank for preserving fresh fluid to be filled into a radiator and a used fluid tank for collecting used fluid from the radiator. A discharge hose is releasably connected to an outlet of the radiator. The discharge hose is selectively connectable to the used fluid tank for discharging the used fluid into the used fluid tank. An intake hose is releasably connected to an inlet of the radiator. The intake hose is selectively connectable to the fresh fluid tank for receiving the fresh fluid therefrom. Pressure/vacuum generation units selectively generate a vacuum inside the used fluid tank to forcibly draw the used fluid from the radiator via the discharge hose and generates a pressure inside the fresh fluid tank to forcibly drive the fresh fluid from the fresh fluid tank into the radiator via the intake hose. The discharge hose is also selectively connectable to the intake hose by a three-way valve for circulating the used fluid to the intake hose. A filtering device is connected between the discharge hose and the intake hose for cleaning the used fluid that flows from the discharge hose to the intake hose. An inlet port is mounted to the filtering device for receiving a cleaning agent that entrains the fluid through the radiator for cleaning the radiator. The force circulation of the fluid through the radiator provides an effective and efficient cleaning operation to the radiator.

10 Claims, 2 Drawing Sheets

RADIATOR CLEANING DEVICE

BACKGROUND OF THE INVENTION

1. Field of the Invention

The present invention relates generally to a device for cleaning an automobile radiator, and in particular to a radiator cleaning device allowing cleaning and coolant replenishment to be performed at the same time.

2. The Related Art

An automobile radiator comprises a container for storage of a predetermined amount of coolant that is guided through an engine of the automobile during the operation thereof for cooling the engine. To ensure good performance of the engine, the radiator must be periodically cleaned and the coolant replaced by fresh coolant. Traditionally, the radiator is cleaned by discharging the coolant contained therein and fresh water or cleaning agent is filled into and discharged from the radiator several times to clean the radiator. Since such a process is done under regular pressure, the result of cleaning operation is poor. Furthermore, residuals of the used coolant and the cleaning agent may be built up inside the radiator and/or the piping thereof causing undesired corrosion.

The conventional way of replenishment of radiator coolant is simply done by filling, under regular pressure, fresh coolant into the radiator tank. This may cause air residual in the radiator tank, reducing operation efficiency of the radiator.

It is thus desired to have a radiator cleaning device that overcomes the above problems.

SUMMARY OF THE INVENTION

An object of the present invention is to provide a radiator cleaning device for efficiently and effectively cleaning an automobile radiator.

Another object of the present invention is to provide a radiator cleaning device for selectively performing radiator cleaning operation and radiator coolant replenishment operation.

A further object of the present invention is to provide a radiator cleaning device for performing radiator cleaning operation without air residual in the radiator.

To achieve the above objects, in accordance with the present invention, there is provided a radiator cleaning device comprising a fresh fluid tank for preserving fresh fluid to be filled into a radiator and a used fluid tank for collecting used fluid from the radiator. A discharge hose is releasably connected to an outlet of the radiator. The discharge hose is selectively connectable to the used fluid tank for discharging the used fluid into the used fluid tank. An intake hose is releasably connected to an inlet of the radiator. The intake hose is selectively connectable to the fresh fluid tank for receiving the fresh fluid therefrom. Pressure/vacuum generation units selectively generate a vacuum inside the used fluid tank to forcibly draw the used fluid from the radiator via the discharge hose and generates a pressure inside the fresh fluid tank to forcibly drive the fresh fluid from the fresh fluid tank into the radiator via the intake hose. The discharge hose is also selectively connectable to the intake hose by a three-way valve for circulating the used fluid to the intake hose. A filtering device is connected between the discharge hose and the intake hose for cleaning the used fluid that flows from the discharge hose to the intake hose. An inlet port is mounted to the filtering device for receiving a cleaning agent that entrains the fluid through the radiator for cleaning the radiator. The force circulation of the fluid through the radiator provides an effective and efficient cleaning operation to the radiator.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 2:
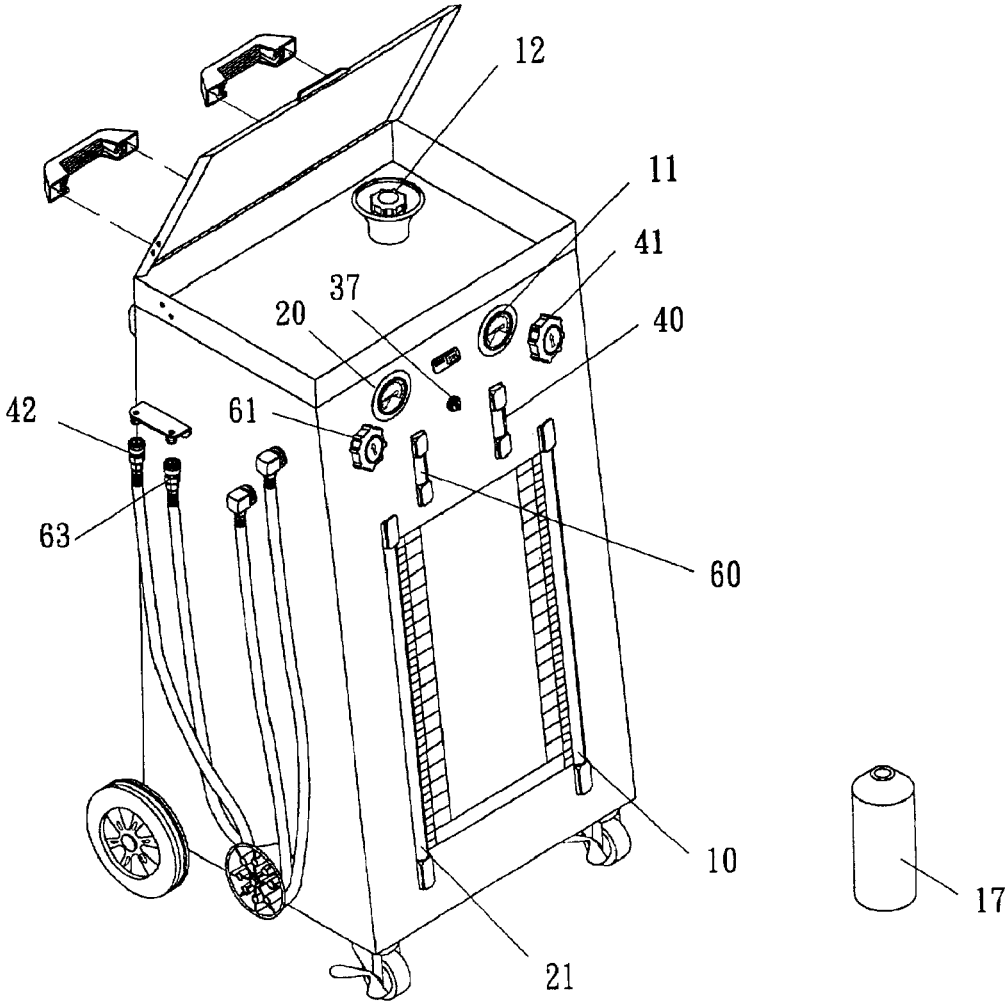
FIG. 2 is a perspective view of the radiator cleaning device of the present invention.

With reference to the drawings and in particular to FIG. 2, a radiator cleaning device constructed in accordance with the present invention comprises a chassis (not labeled) movably supported by casters (not labeled) and forming a fresh fluid tank 1 and a used fluid tank 2 for storing fluids, such as radiator coolant, therein. Observing windows 10, 21 of the fresh fluid tank 1 and the used fluid tank 2 are formed on a front wall of the chassis for visual observation of the amounts of the fluids contained in the tanks 1, 2. Scales (not labeled) are also formed on the front wall for measuring the amounts of fluids inside the tanks 1, 2. A fresh fluid inlet port 12 is formed on a top side of the chassis for replenishing fresh fluid into the, fresh fluid tank 1. Intake and discharge hoses 42, 63 are mounted on a side wall of the chassis for respectively and releasably connect to the inlet and outlet of radiator (not shown). The intake and discharge hoses 42, 63 are provided with air-tight tittings for air-tight connection with the inlet and outlet of the radiator.

Figure 1:
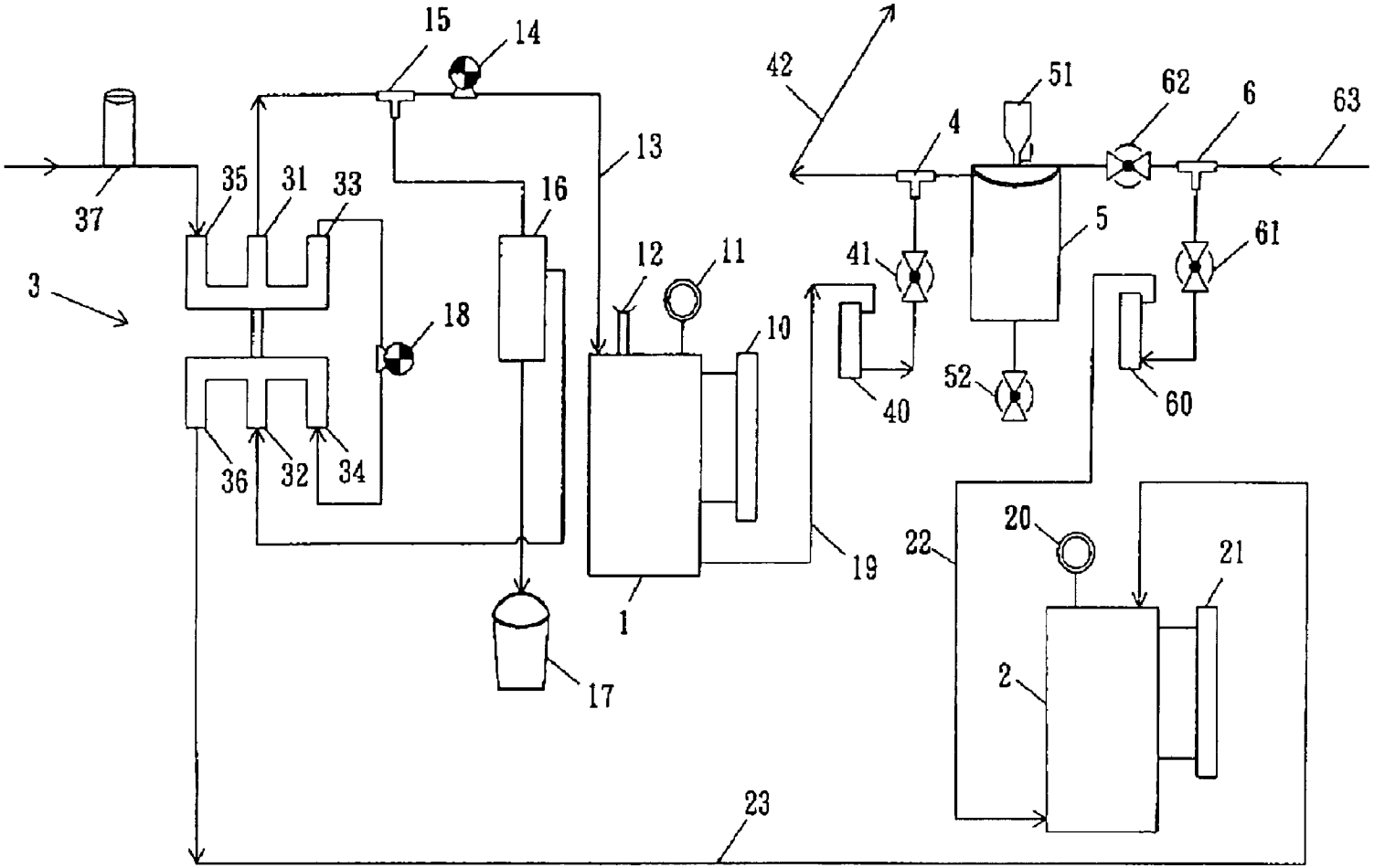
FIG. 1 is a schematic view of a radiator cleaning device constructed in accordance with the present invention.

Also referring to FIG. 1, the discharge hose 63 is connected to the used fluid tank 2 by a pipe 22 on which a three-way valve 6 and a ball valve 61 are mounted. Preferably, an observing window 60 is mounted between the ball valve 61 and the used fluid tank 2 for visual observation of the used fluid flowing into the used fluid tank 2. The used fluid that is originally contained in the automobile radiator is discharged through the discharge hose 63 and the valves 6, 61 to the used fluid tank 2. The amount of the used fluid that flows into the used fluid tank 2 can be observed through the observing window 21.

Another ball valve 62 connects the three-way valve 6 to a filtering device 5 which is in turn connected to the intake hose 42 by another three-way valve 4 whereby the used fluid that flows out of the radiator may be selectively circulated back to the radiator via the intake hose 42 after having been filtered and cleaned by the filtering device 5. A cleaning agent inlet 51 is formed with the filtering device 5 whereby a cleaning agent may be selectively added into and entraining the fluid flowing into the radiator via the intake hose 42. The filtering device 5 is also provided with a ball valve 52 for draining purposes.

The fresh fluid tank 1 is connected to the three-way valve 4 via a pipe 19 on which a ball valve 41 is mounted whereby the fresh fluid is selectively supplied to the intake hose 42 for being filled into the radiator. Preferably, an observing window 40 is mounted between the fresh fluid tank 1 and the ball valve 41 for visual observation of the flow of the fresh fluid to the intake hose 42. To replenish fresh fluid to the radiator, the fresh fluid is filled into the fresh fluid tank 1 via the fresh fluid inlet port 12 and the amount of the fresh fluid inside the fresh fluid tank 1 can be observed through the observing window 10.

In accordance with the present invention, to effectively clean a radiator, means for generating pressure/vacuum is connected to the fresh fluid tank 1 and the used fluid tank 2 for forcibly circulating the fluid through the radiator to perform effective cleaning operation. The means for generating pressure/vacuum in accordance with the present invention comprises a vacuum generator 16 connected to the used fluid tank 2 via a six-way valve 3. The six-way valve 3 has six ports 31–36. A vacuum port of the vacuum generator 16 is connected to the second port 32 of the six-way valve 3 and the sixth port 36 of the six-way valve 3 is connected to the used fluid tank 2 by a pipe 23. Preferably, a vacuum gauge 20 is connected to the used fluid tank 2 for reading the vacuum inside the used fluid tank 2.

The first port 31 of the six-way valve 3 is connected to the fresh fluid tank 1 by a pipe 13 on which a three-way valve 15 is mounted. Preferably, a pressure regulator 14 is mounted between the three-way valve 15 and the fresh fluid tank 1. The vacuum generator 16 has a pressure port connected to the three-way valve 15. A pressure regulator 18 is connected between the third and fourth ports 33, 34 of the six-way valve 3. A pressure source (not shown), such as an air compressor, is connected to the fifth port 35 of the six-way valve 3 via a control switch 37.

Preferably, a pressure gauge 11 is mounted to the fresh fluid tank 1 for reading the pressure inside the fresh fluid tank 1.

A collection container 17 is connected to the vacuum generator 16 for collecting water generated during the operation of the vacuum generator 16.

In operation, fresh fluid, such as fresh coolant, is filled into the fresh fluid tank 1 via the inlet port 12. By means of the operation of the vacuum generator 16, as well as the pressure provided by the external pressure source, a pressure is applied to the fresh fluid tank 1 for forcibly driving the fresh fluid contained in the fresh fluid tank 1 into the intake hose 42 and eventually flowing into the radiator under the pressure applied to the tank 1. In the mean time, a vacuum is applied to the used fluid tank 2 via the pipe 23 which causes forcible suction of the used fluid from the radiator via the discharge hose 63. By means of the forcible drive of the fresh fluid into the radiator by the intake hose 42 and the forcible suction of the used fluid from the radiator by the discharge hose 63, a more effective and efficient cleaning operation can be achieved.

The cleaning agent can entrain the fresh fluid that is forcibly driven into the intake hose 42 by the pressure inside the fresh fluid tank 1. The fluid that contains the cleaning agent can flow through the radiator and the discharge hose 63 and eventually circulate back to the filtering device 5 via the ball valve 62 to remove the contaminants carried thereby. The fluid can circulate several times to remove the contaminants inside the radiator.

It is apparent that the present invention as detailed with the above described embodiment provides a radiator cleaning device that performs a radiator cleaning operation with fluid driven by pressure difference between intake and discharge of the radiator. This allows a more effective and efficient cleaning operation of the radiator. In addition, radiator cleaning and coolant replenishment can be done in a single operation cycle with the same equipment. No air or residual coolant are left inside the radiator. Thus, a better protection to the radiator can be obtained.

Although the present invention has been described with reference to the preferred embodiment with reference to the drawings thereof, it is apparent to those skilled in the art that a variety of modifications and changes may be made without departing from the scope of the present invention which is intended to be defined by the appended claims.

What is claimed is:

1. A radiator cleaning device comprising: (1, 2, 3, 4, 5 and 6)

a first tank for preserving fresh fluid adapted to be filled into a radiator;

a second tank adapted to collect used fluid from the radiator;

a discharge hose adapted to be connected to an outlet of the radiator, the discharge hose being selectively connectable to the second tank for discharging the used fluid into the second tank;

an intake hose adapted to be connected to an inlet of the radiator, the intake hose being selectively connectable to the first tank for receiving the fresh fluid therefrom;

first means for generating a vacuum inside the second tank to forcibly draw the used fluid from the radiator into the second tank via the discharge hose and for generating a pressure inside the first tank to forcibly drive the fresh fluid from the first tank into the radiator via the intake hose; and second means for switching the used fluid flowing from the discharge hose from moving toward the second tank into moving toward the intake hose;

wherein the second means comprises a three-way valve connected to the discharge hose, the three-way valve being connected to the intake hose and the second tank respectively by a ball valve;

wherein second means further comprises a filtering device connected between the three-way valve and the intake hose for filtering the fluid flowing from the discharge hose toward the intake hose;

wherein an inlet port is mounted to the filtering device for receiving a cleaning agent that entrains the fluid flow from the discharge hose to the intake hose for cleaning the radiator;

wherein the filtering device and the first tank are connected to the intake hose by a three-way valve, a ball valve being mounted between the three-way valve and the first tank; and wherein the first means comprises a six-way valve having first, second, third, fourth, fifth and sixth ports, the first port being connected to the first tank, the second port being connected to a vacuum port of a vacuum generating device, the third and fourth ports being connected to each other by a pressure regulator, the fifth port being adapted to connect to an external pressure source, the sixth port being connected to the second tank, the vacuum generating device having a pressure port connected between the first tank and the first port of the six-way valve by a three-way valve whereby a vacuum is applied by the first means to the second tank and a pressure is applied to the first tank by the first means.

2. The radiator cleaning device as claimed in claim 1, wherein the second means comprises a three-way valve connected to the discharge hose, the three-way valve being connected to the intake hose and the second tank respectively by the ball valve.

3. The radiator cleaning device as claimed in claim 2, wherein second means further comprises a filtering device connected between the three-way valve and the intake hose for filtering the fluid flowing from the discharge hose toward the intake hose.

4. The radiator cleaning device as claimed in claim 3, wherein an inlet port is mounted to the filtering device for receiving a cleaning agent that entrains the fluid flow from the discharge hose to the intake hose for cleaning the radiator.

5. The radiator cleaning device as claimed in claim 3, wherein the filtering device and the first tank are connected to the intake hose by the three-way valve, a ball valve being mounted between the three-way valve and the first tank.

6. The radiator cleaning device as claimed in claim 1, wherein the first tank comprises a pressure gauge connected thereto and wherein the second tank comprises a vacuum gauge connected thereto.

7. The radiator cleaning device as claimed in claim 1, wherein the first tank comprises an observing window for visual observation of amount of the fresh fluid inside the first tank and wherein the second tank comprises an observing window for visual observation of amount of the used fluid inside the second tank.

8. The radiator cleaning device as claimed in claim 1, wherein the discharge hose and the intake hose comprise air-tight fittings for connection with outlet and inlet of the radiator in an air-tight manner.

9. A radiator cleaning device comprising:

a first tank for preserving fresh fluid adapted to be filled into a radiator;

a second tank adapted to collect used fluid from the radiator;

a discharge hose adapted to be connected to an outlet of the radiator, the discharge hose being selectively connectable to the second tank for discharging the used fluid into the second tank;

an intake hose adapted to be connected to an inlet of the radiator, the intake hose being selectively connectable to the first tank for receiving the fresh fluid therefrom;

first means for generating a vacuum inside the second tank to forcibly draw the used fluid from the radiator into the second tank via the discharge hose and for generating a pressure inside the first tank to forcibly drive the fresh fluid from the first tank into the radiator via the intake hose; and second means for switching the used fluid flowing from the discharge hose from moving toward the second tank into moving toward the intake hose;

wherein the second means comprises a three-way valve connected to the discharge hose, the three-way valve being connected to the intake hose and the second tank respectively by a ball valve; and wherein an observing window is mounted between the second tank and the three-way valve for visually observing the used fluid flowing toward the second tank.

10. A radiator cleaning device comprising:

a first tank for preserving fresh fluid adapted to be filled into a radiator;

a second tank adapted to collect used fluid from the radiator;

a discharge hose adapted to be connected to an outlet of the radiator, the discharge hose being selectively connectable to the second tank for discharging the used fluid into the second tank;

an intake hose adapted to be connected to an inlet of the radiator, the intake hose being selectively connectable to the first tank for receiving the fresh fluid therefrom;

first means for generating a vacuum inside the second tank to forcibly draw the used fluid from the radiator into the second tank via the discharge hose and for generating a pressure inside the first tank to forcibly drive the fresh fluid from the first tank into the radiator via the intake hose; and second means for switching the used fluid flowing from the discharge hose from moving toward the second rank into moving toward the intake hose;

wherein the second means comprises a three-way valve connected to the discharge hose, the three-way valve being connected to the intake hose and the second tank respectively by a ball valve;

wherein second means further comprises a filtering device connected between the three-way valve and the intake hose for filtering the fluid flowing from the discharge hose toward the intake hose;

wherein the filtering device and the first tank are connected to the intake hose by a three-way valve, a ball valve being mounted between the three-way valve and the first tank; and wherein an observing window is mounted between the three-way valve and the first tank for visually observing the fresh fluid flowing toward the intake hose.

* * * * *